US012257488B1

(12) United States Patent
Marino

(10) Patent No.: US 12,257,488 B1
(45) Date of Patent: Mar. 25, 2025

(54) ELECTRONIC BOXING BAG

(71) Applicant: Fitsmartgear, Pompano Beach, FL (US)

(72) Inventor: Erica Marino, Pompano Beach, FL (US)

( * ) Notice: Subject to any disclaimer, the term of this patent is extended or adjusted under 35 U.S.C. 154(b) by 0 days.

(21) Appl. No.: 18/769,704

(22) Filed: Jul. 11, 2024

Related U.S. Application Data

(63) Continuation-in-part of application No. 17/524,337, filed on Nov. 11, 2021, now abandoned.

(51) Int. Cl.
*A63B 69/20* (2006.01)

(52) U.S. Cl.
CPC ..... *A63B 69/305* (2022.08); *A63B 2220/80* (2013.01); *A63B 2225/50* (2013.01)

(58) Field of Classification Search
CPC H01H 2239/048; A63B 69/305; A63B 69/32; A63B 69/22; A63B 69/222; A63B 69/224; A63B 2220/80; A63B 2024/0065; A63B 2071/0625; A63B 2225/20; A63B 2225/50
See application file for complete search history.

(56) References Cited

U.S. PATENT DOCUMENTS 4,941,660 A * 7/1990 Winn ..... A63B 24/0003 702/41
7,909,749 B2 * 3/2011 Sheedy ..... A63B 24/0062 482/84
9,227,128 B1 * 1/2016 Carfagna, Jr. ..... A63B 71/0622
9,586,120 B1 * 3/2017 Sotelo ..... A63B 69/305
9,782,652 B2 10/2017 Williamson
10,441,848 B1 * 10/2019 Skhisov ..... G06F 3/0304
2003/0216228 A1 * 11/2003 Rast ..... A63B 47/021 482/84
2003/0217582 A1 * 11/2003 Reinbold ..... A63B 71/06 73/12.09
2008/0260299 A1 * 10/2008 Ng ..... A63B 69/32 383/3
2017/0036087 A1 * 2/2017 Codrington ..... B32B 9/025
2017/0319904 A1 * 11/2017 Deochand ..... A63B 69/305
2022/0305363 A1 * 9/2022 Rivera ..... A63B 69/32

* cited by examiner

*Primary Examiner* — Megan Anderson
*Assistant Examiner* — Jonathan A Dicuia
(74) *Attorney, Agent, or Firm* — Sanchelima & Associates, P.A.; Jesus Sanchelima; Christian Sanchelima

(57) ABSTRACT

An electronic boxing bag including a heavy bag assembly, a gloves assembly, a band assembly, and a computerized device assembly. The bag assembly has a bag with a sensor, a speaker, a screen, and a camera embedded therein. The sensor collects hitting performance data. The data is displayed on the screen and in the computerized device. The gloves assembly and the band assembly include sensors to measure training data of the wearer. The gloves assembly, band assembly, and heavy assembly are connected to the computerized device through a communication network. Multiple heavy bags are connectable to permit training between multiple users. The electronic boxing bag provides real time visual feedback while training.

13 Claims, 6 Drawing Sheets

ELECTRONIC BOXING BAG

OTHER RELATED APPLICATIONS

The present application is a continuation-in-part of pending U.S. patent application Ser. No. 17/524,337, filed on Nov. 11, 2021, which is hereby incorporated by reference.

BACKGROUND OF THE INVENTION

1. Field of the Invention

The present invention relates to heavy bags and, more particularly, to an electronic boxing bag that includes performance tracking and personal training routines.

2. Description of the Related Art

Several designs for heavy bags have been designed in the past. None of them, however, include performance and fitness tracking communicated to the user via a digital screen and a smartphone application.

Applicant believes that a related reference corresponds to U.S. Pat. No. 9,782,652 issued for a heavy bag workout monitor system for receiving and analyzing quantity, location, and magnitude of physical contact and transmitting the information to a user interface. Applicant believes another related reference corresponds to U.S. Pat. No. 9,227,128 for a heavy bag for boxing with integral electronics and sensors for visualizing and analyzing impact forces. None of these references, however, teach of an electronic boxing bag with integrated sensor pads working in conjunction with a digital screen and sensors on a user's body. The electronic boxing bag provides real time visual feedback while training.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an electronic boxing bag with integrated sensors that track physical performance.

It is another object of this invention to provide an electronic boxing bag that communicates with sensors located on a user's body.

It is still another object of the present invention to provide an electronic boxing bag with a digital display to communicate fitness level and performance to a user.

It is yet another object of the present invention to provide an electronic boxing bag that provides real time visual feedback while training.

It is yet another object of the present invention to provide an electronic boxing bag that permits the communication between multiple boxing bags allowing users to train simultaneously.

It is yet another object of the present invention to provide an electronic boxing bag that includes training plans for different levels of boxing.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
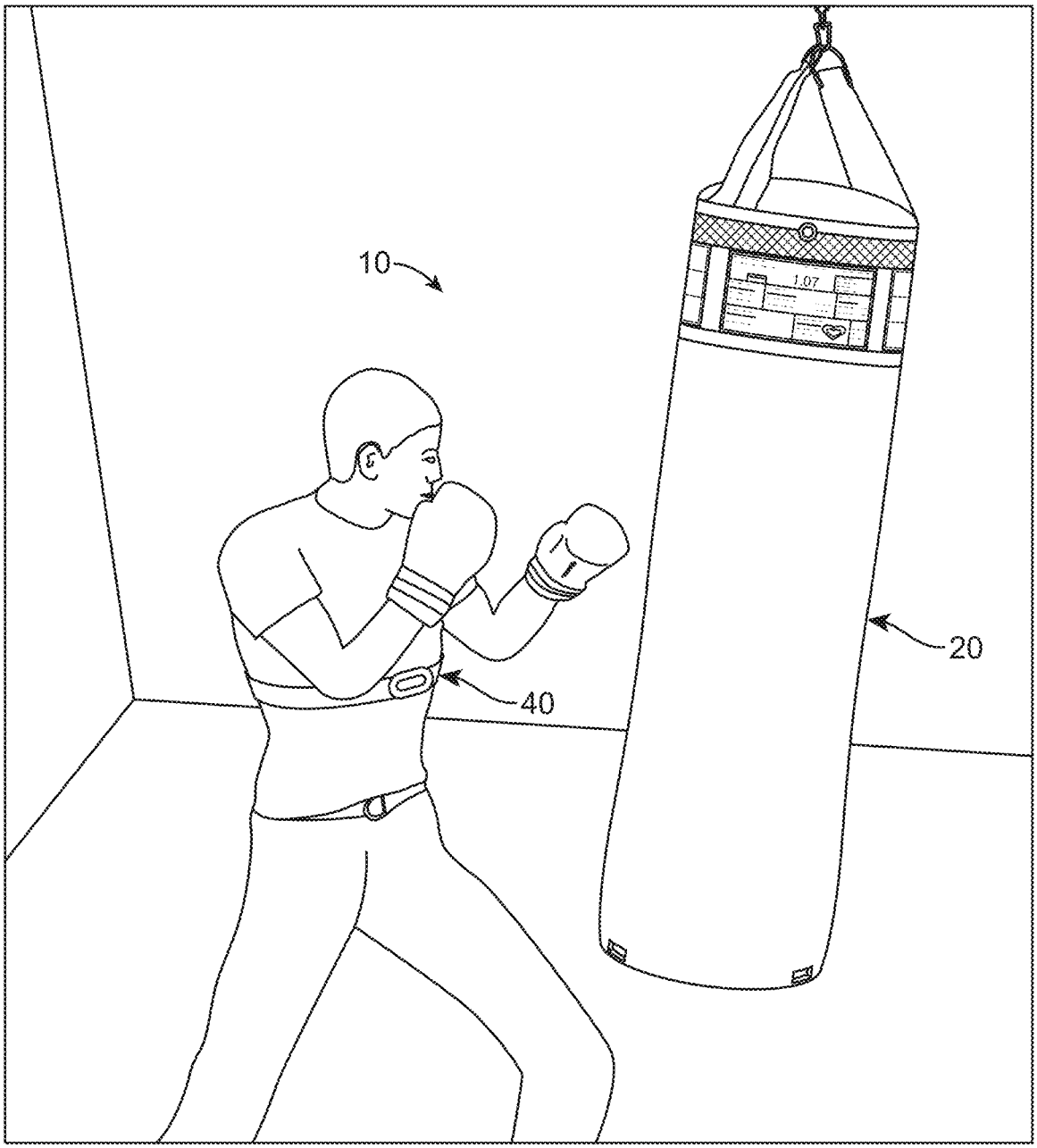
FIG. 1 represents an isometric operational view of the present invention 10 showing a user training hitting the heavy bag assembly 20.

Referring now to the drawings, where the present invention is generally referred to with numeral 10, it can be observed that it basically includes a heavy bag assembly 20, a band assembly 40, and a gloves assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
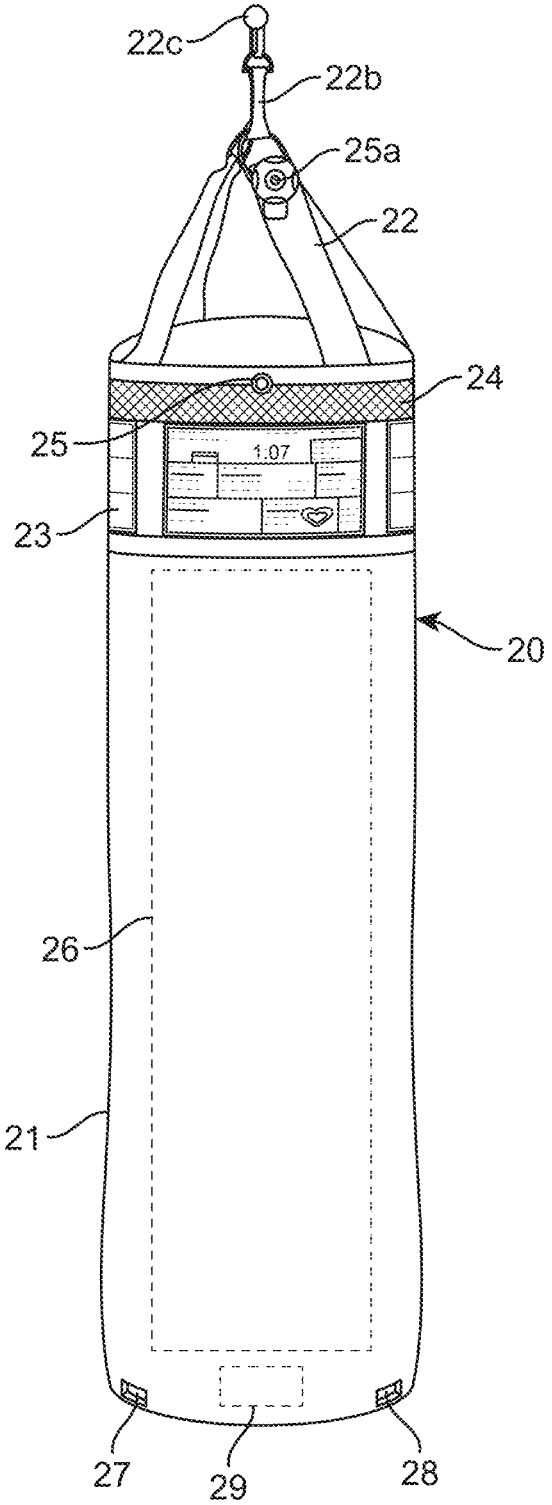
FIG. 2 shows an isometric operational view of the heavy bag assembly 20 with a partial see-through view depicting the sensor 26 embedded in the heavy bag 21.
Figure 3:
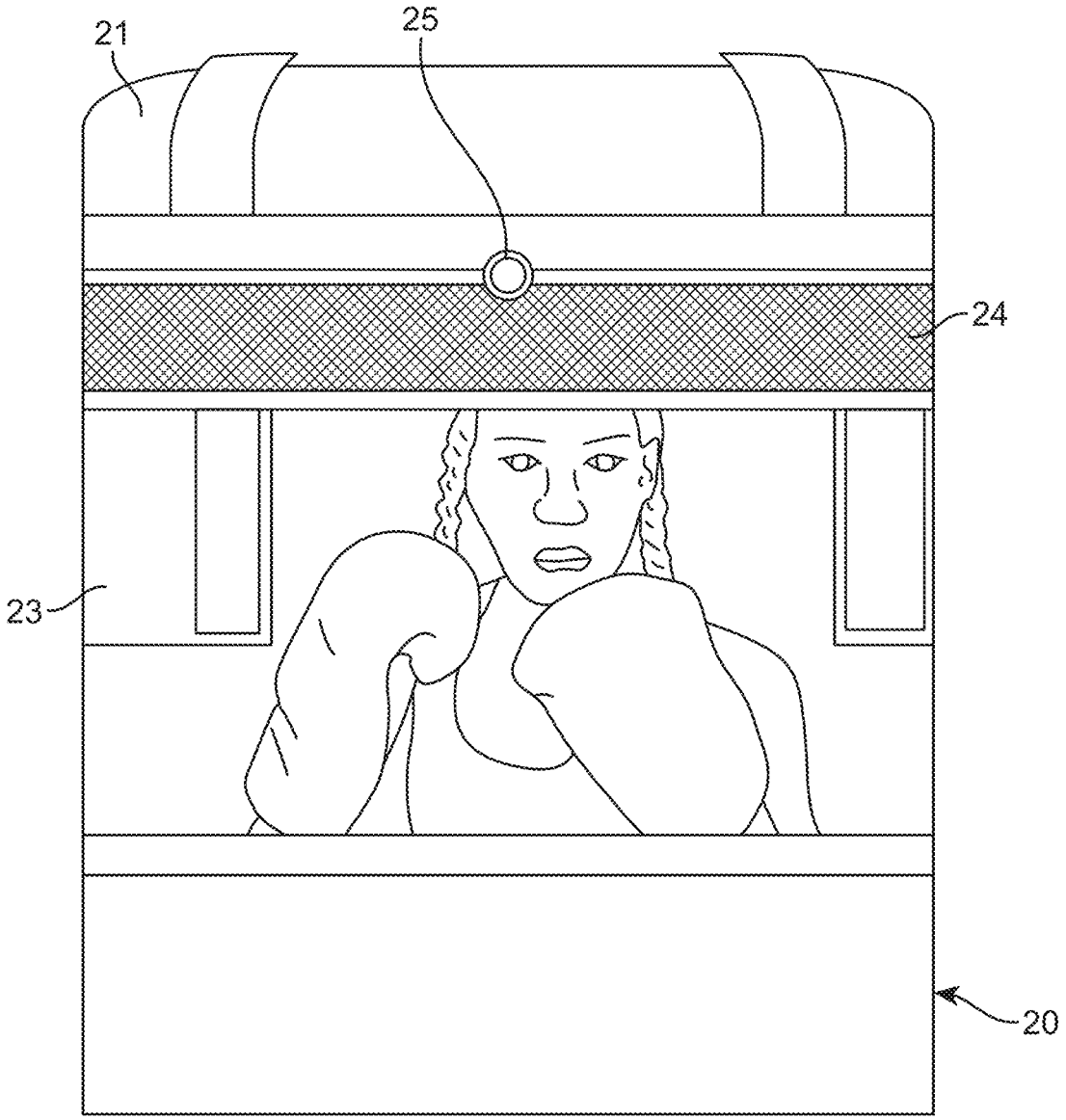
FIG. 3 illustrates an enlarged view of the heavy bag assembly 20 showing the screen 23 and the speaker 24 located on a top portion of the heavy bag 21.

Best observed in FIG. 2 and FIG. 3, the heavy bag assembly 20 includes a heavy bag 21. In one of the preferred embodiments, the heavy bag 21 may have a cylindrical shape with a top portion, a bottom portion and a lateral side. The top portion may be stitched to a top edge of the lateral side. The bottom portion may be stitched to a bottom edge of the lateral side. An exterior surface of the heavy bag 21 may be made of polyester, leather, or fabric. An interior of the heavy bag 21 may be filled with a predetermined amount of cushion, sand, sawdust, or any other suitable material for heavy bags.

The heavy bag 21 may further include mounting straps 22. The mounting straps 22 may be fastened and equally spaced circumferentially about a top lateral edge of the heavy bag 21. The mounting straps 22 may be stitched to the heavy bag 21 or fastened adhesively. The mounting straps 22 may be made of a strong piece of cloth or any other suitable material. Each of the mounting straps 22 may include a ring at a distal end thereof. The ring may be made of metal. The ring and the mounting straps 22 may allow hanging the heavy bag 21 to a desired hanging point via a mounting clip.

Figure 7:
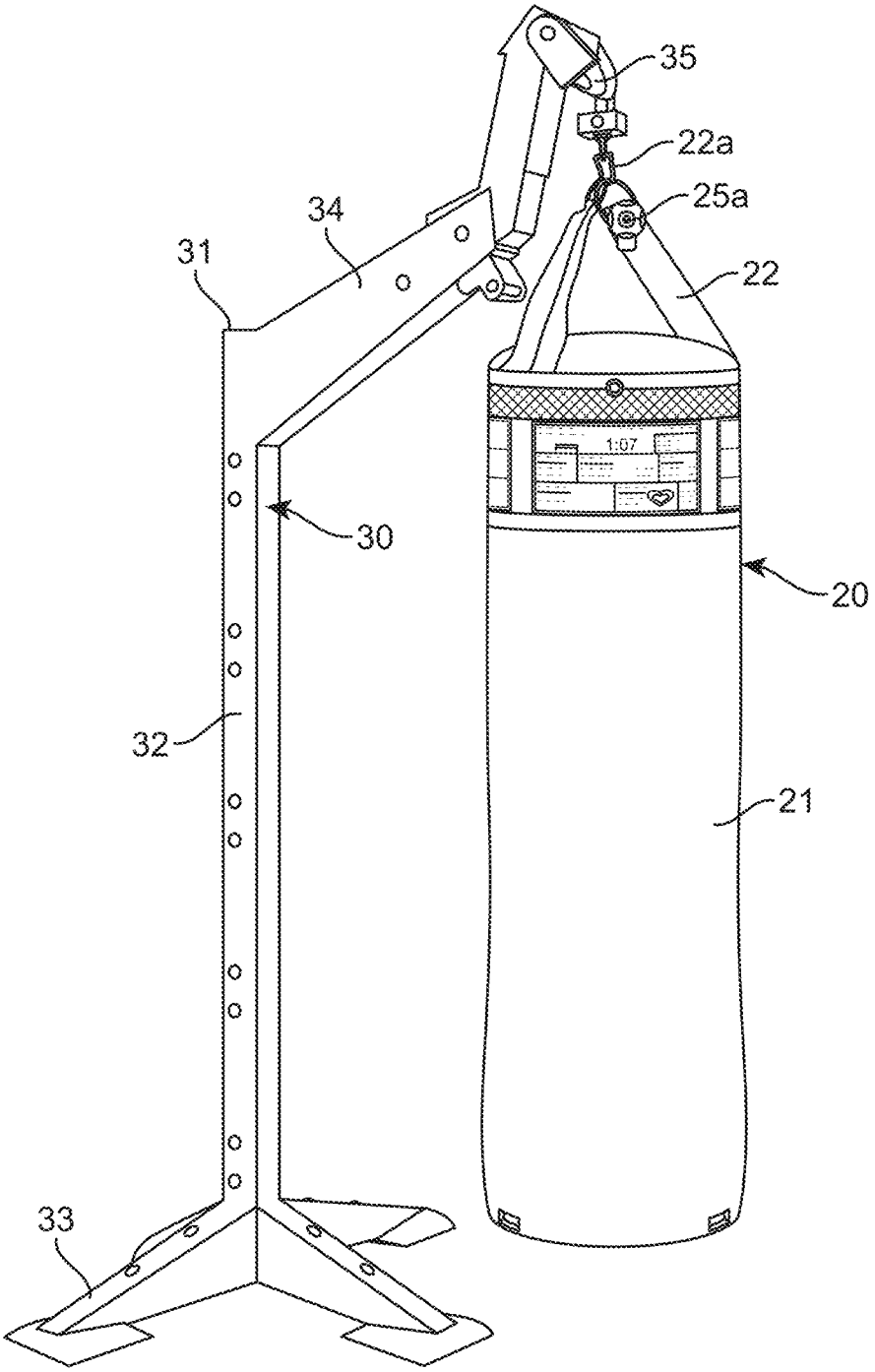
FIG. 7 depicts an isometric view of the heavy bag assembly 20 mounted to a stand assembly 30.

The mounting straps 22 may allow mounting the heavy bag 21 to the ceiling of a gym or training room. Alternatively, the heavy bag assembly 20 may be hung to a stand assembly 30 as observed in FIG. 7. The stand assembly 30 may include a stand 31 with a support base 33, a first bar 32, and second bar 34. A bottom end of the first bar 32 may be attached to the support base 33 via bolts, welding, or any other suitable attaching method. The second bar 34 may be attached to a top end of the first bar 32 by welding, bolts or the like. a distal end of the second bar 34 may have a mounting element 35 attached thereto. The heavy bag assembly 20 may be hung to the mounting element 35 by the mounting straps 22 with clips 22*a*. The stand assembly 30 may be made of a metal or any other material with good strength to support the weight of the heavy bag assembly 20 and the hits. It should be understood that it also may be suitable to have a mounting element located at a roof of a room to hang the heavy bag assembly 20 to the roof.

The heavy bag assembly 20 may further include a screen 23, a speaker 24, a first camera 25, a second camera 25*a*, a sensor 26, a first charger port 27, a second charger port 28, and a microcontroller 29 controller. Preferably, the screen 23 may be embedded on a top portion of the heavy bag 21. The screen 23 may be a 360° screen surrounding an entire perimeter of the heavy bag 21 allowing the user to visualize the screen 23 in the front, rear, and lateral sides of the heavy bag 21. The screen 23 may include an on, off, and reset button. The screen 23 may be a LCD screen, a LED screen, an OLED screen, or any other suitable screen. The screen 23 may be a touch screen to allow a user to navigate through a menu. The screen 23 may display statistics, videos for training, instructions, a setup menu, and any other suitable information.

The speaker 24 may be embedded to a top portion of the heavy bag 21. The speaker 24 may be located above the screen 23. In one embodiment, the speaker 24 may be a 360° speaker surrounding an entire perimeter of the heavy bag 21. The speaker 24 may play music to allow a user boxing and training with the rhythm of the music. The speaker 24 may have an integrated microphone to allow voice commands. The integrated microphone may also allow communication between different heavy bag users. In one of the preferred embodiments, the sensor 26 may be embedded in the interior of the heavy bag 21 in contact with the heavy bag 21. The sensor 26 may be a single sensor. It also may be suitable to have a plurality of small sensors distributed on an entire interior surface of the heavy bag 21.

The sensor 26 may be a pressure sensor, a force sensor, a capacitive sensor, or any other type of sensor capable of measuring hit force applied to the heavy bag 21. The sensor 26 may also detect the areas where the hits are applied in the heavy bag 21. The sensor 26 may further may measure the hit count and the hit speed. The microcontroller 29 may be embedded inside the heavy bag 21. The microcontroller 29 may process the data measured by the sensor 26. The microcontroller 29 may be programmed to track a record of the hitting force, hitting speed, hitting area, and hit count of a user. The microcontroller 29 may display the statistics of a user via the screen 23.

The first camera 25 may be mounted on a top portion of the heavy bag 21 above the speaker 24 as observed in FIG. 2 and FIG. 3. In one embodiment, the first camera 25 may be a built-in camera fully integrated in the heavy bag assembly 20. It also may be suitable for the first camera 25 to be an attachable camera. It also may be suitable to mount the first camera 25 to a portion under the speaker 24. The second camera 25*a* may be an optional attachment that may be mounted to the ring portion of the mounting straps 22. The mounting straps 22 may have a mounting member 22*b* attached therein. The mounting member 22*b* may have a camera holder 22*c* which may be used to receive a second camera 25*a* therein. The first camera 25 and the second camera 25*a* may allow to film a user session hitting the heavy bag 21 for a posterior analysis of the training. The first camera 25 may further allow live streaming to video conference to a secondary user utilizing the present invention 10 in another location. Thereby, facilitating a joint workout session between the user and a secondary user or multiple users. The second camera 25*a* may allow the user to record an entire training session.

The Microcontroller may incorporate wireless communication means to transmit and receive data via a communication network 50. The communication network 50 may allow the communication between multiple users utilizing the present invention 10. The communication network 50 may further allow the communication between the heavy bag assembly 20 and the computerized device 80. In one of the preferred embodiments, the computerized device 80 may be a smartphone. It also may be suitable to have the computerized device 80 being a tablet, a computer, or the like. The computerized device 80 may be programmed with an app 82. The app 82 may be programmed to display the data collected from the sensor 26.

Figure 4:
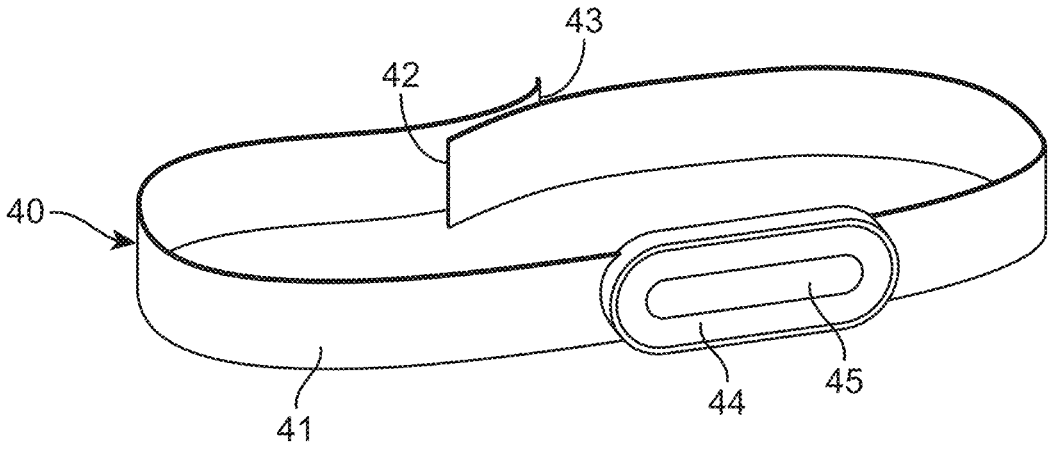
FIG. 4 is a representation of an isometric view of the band assembly 40 including the band sensor 44.

Referring now to FIG. 4, the band assembly 40 may include a band 41. The band 41 may be made of cloth, an elastic band, or any suitable material. The band 41 may have a first end with first fastener 42 and a second end with a second fastener 43. In one embodiment, the first fastener 42 may be hook fasteners and the second fastener 43 may be loop fasteners. In other embodiments, the first fastener 42 and the second fastener 43 may be other suitable kinds of fasteners such as zip fasteners, buttons, magnets, or the like. The first fastener 42 and second fastener 43 may cooperate to removably attach the band 41 to a portion under the chest of a user.

The band assembly 40 may further include a band sensor 44 and a second microcontroller 45. The band sensor 44 and the second microcontroller 45 may be embedded to a middle portion of the heavy bag 21. The band sensor 44 may be a heart rate sensor, a calories sensor or any other suitable sensor to measure the fitness activity variables of a user. The band sensor 44 may measure the heart rate and the calories burnt of a user during training. The second microcontroller 45 may have wireless communication means to transmit the data captured by the band sensor 44. The communication network 50 may allow the communication from the second microcontroller 45 of the band assembly 40 to the heavy bag assembly 20 and to the computerized device 80. The screen 23 may display the statistics and information collected by the band sensor 44. The computerized device 80 may display the statistics captured by the band sensor 44. The band assembly 40 may be used while training and hitting the heavy bag assembly 20. The sensor 26 of the heavy bag assembly 20 may measure the hit force, the hit count, and the hit speed, while, the band sensor 44 measures the calories and the heart rate, allowing the user to track these parameters.

Figure 5:
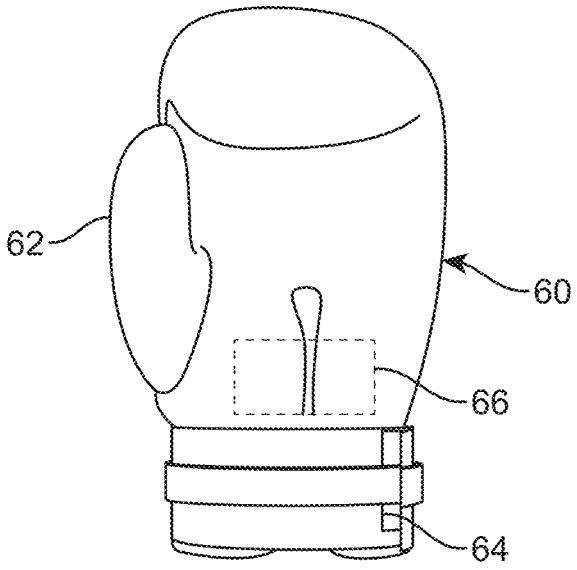
FIG. 5 depicts a front view of the gloves assembly 60 showing a glove 62 with an integrated glove sensor 66.
Figure 6:
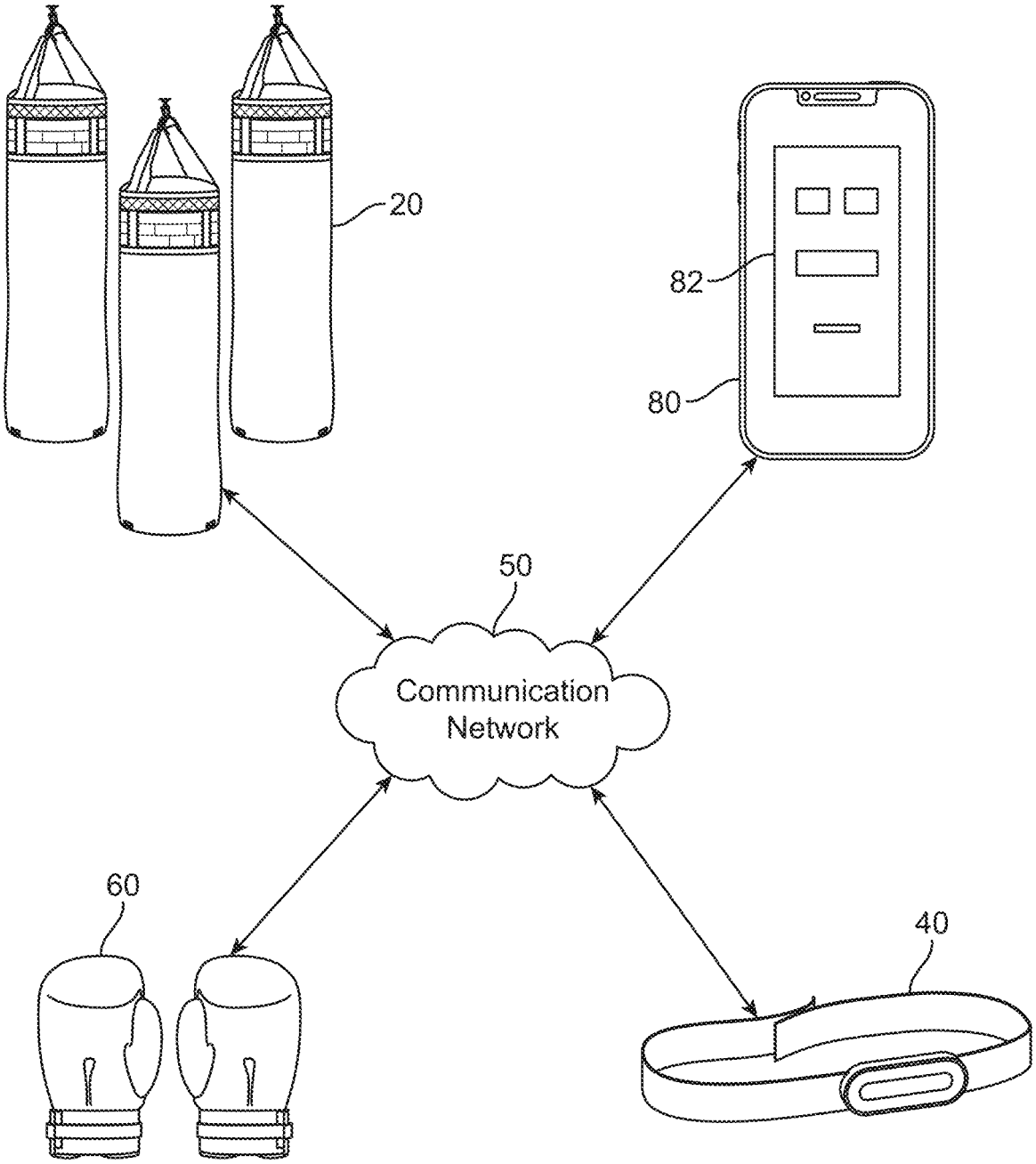
FIG. 6 is a diagram representing the communication through a communication network 50 between the heavy bag assembly 20, the band assembly 40, gloves assembly 60, and computerized device 80.

Referring now to FIG. 5, the gloves assembly 60 may include a pair of gloves. Each glove 62 may be a boxing glove. Each glove 62 may have a securing attachment 64 to secure the glove 62 to the hands of a user. Each glove 62 may have an integrated glove sensor 66 embedded in the glove 62. The glove sensor 66 may measure physical variables of the user during training including heart rate and calories. The glove sensor 66 may further measure the hit force, hit counting, and hit speed. The gloves assembly 60 may be in wireless communication with the heavy bag assembly 20 and with the computerized device 80 to process and display the statistics captured by the glove sensor 66 in the screen 23 and in the app 82. It should be understood that the app 82 may be configured to record all the statistics data from a training session.

In one configuration, a user might choose to wear regular boxing gloves in combination with the band assembly 40 and the sensor 26 in the heavy bag assembly 20. The band sensor 44 in the band assembly 40 may be used in combination with the sensor 26 of the heavy bag 21 to determine and track the heart rate, calories, the hit force, hit counting, and hit speed during a training. Alternatively, the user may choose to purchase the gloves assembly 60 with two smart gloves 62 to measure and track the user's heart rate, calories, hit force, hit counting and hit speed.

The communication network 50 may be a wireless communication network that allows the transmission of data between the heavy bag assembly 20, the band assembly 40, the gloves assembly 60, and the computerized device 80. In one embodiment, the computerized device 80, the heavy bag assembly 20, the band assembly 40, and the gloves assembly 60 may be wirelessly connected via Bluetooth™. The communication network 50 may allow the communication between multiple users utilizing the heavy bag assembly 20. The app 82 and the screen 23 may be programmed to record the data captured by the different sensors for a user. The app may be programmed to track the performance of the users and to provide personalized routines to improve the training and technique of the user. The app 82 may learn from the user to improve and provide training routines. The first camera 25 and the first camera 25 along with the screen 23 may allow the users to workout with other users. It also may be suitable to have a personal training assistant to provide personalized live workout sessions by video streaming.

The screen 23 may be monitored and controlled by the app 82. The screen 23 may have different screen options including statistics display and workout recording, training on demand or virtually fighting with friends, and a beat boxing music workout feature. All the training modes may record and save the statistics of the user. The music workout feature may allow to indicate what areas of the heavy bag 21 to hit similarly to a dance dance revolution game. The music workout feature may indicate different types of hitting including but not limited tap jab, power jab, tap cross, power cross, hook, rear hook, upper cut, and rear upper cut hit. Best observed in FIG. 2 and FIG. 7 The screen 23 may display the calories in a bottom left portion, the hit count in a left portion, and the date and set time in a top left portion thereof. The set time may show the time left for reset. The screen 23 may display the hit speed in a central portion including average speed and maximum speed. The top central portion may display the hitting time and a top right portion may display the set rounds. The right portion of the screen 23 may allow to display and control the music. A right portion of the screen 23 may display the hitting force. The central bottom portion of the screen 23 may display the heart rate of the user including average and max heart rate. A bottom right portion of the screen 23 may display and control the power and reset status of the electronic boxing bag. The screen 23 may have a built-in timer and a built-in clock incorporated therein. The app 82 and the screen 23 may allow a user to choose training sessions for right hand users and for left hand users. The app 82 and the screen 23 may provide introduction training video to the users showing how to perform the different types of hitting including but not limited tap jab, power jab, tap cross, power cross, hook, rear hook, upper cut, and rear upper different types of hitting including but not limited tap jab, power jab, tap cross, power cross, hook, rear hook, upper cut, and rear upper cut hit cut hit The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an electronic boxing bag, comprising:

a) a heavy bag assembly including a heavy bag with at least one integrated sensor embedded therein measuring data, said heavy bag assembly further includes a screen, a speaker and a first camera mounted on the heavy bag; wherein the heavy bag assembly further includes mounting straps with clips to mount said heavy bag to a mounting element; wherein the heavy bag assembly further includes a second camera mounted on top ends of the mounting straps, said second camera is configured to record training sessions;

b) a fitness sensor assembly including a fitness sensor mounted on a user accessory, said fitness sensor is configured to measure training data from the user; and c) a computerized device wirelessly connected to the heavy bag assembly and to the fitness sensor assembly to record the measured data and the training data.

2. The system for an electronic boxing bag set forth in claim 1, wherein said mounting straps are mounted to a stand assembly, said stand assembly includes a first bar, a second bar, a base support and a mounting member, said first bar is vertically attached to said base support, said second bar is attached to the first bar, said mounting member is attached to said second bar, said mounting straps are configured to hang the heavy bag from the mounting member of the stand assembly.

3. The system for an electronic boxing bag set forth in claim 1, wherein the mounting element is located at a roof to hang the heavy bag to the roof.

4. The system for an electronic boxing bag set forth in claim 1, wherein said speaker is a 360° speaker, said screen is a 360° screen, said screen, said first camera and said speaker are embedded in a top portion of the heavy bag, wherein said speaker is located above the screen, said screen has a built-in clock and timer.

5. The system for an electronic boxing bag set forth in claim 1, wherein the computerized device is a smartphone programmed with an app, said app displaying the measured data of the user, wherein said app records the measured data of the user, said app is configured to display training introduction sessions for users, said app includes an option to choose training for left hand users or right hand users.

6. The system for an electronic boxing bag set forth in claim 1, wherein said screen is wirelessly connected to a second bag assembly, wherein the screen is configured to allow a user to workout with other users.

7. The system for an electronic boxing bag set forth in claim 1, wherein the screen has a training mode that indicates the areas and types of hits to be done.

8. The system for an electronic boxing bag set forth in claim 1, wherein said fitness sensor is embedded on gloves, wherein said fitness sensor measures hit force, hit speed, hit counting, calories, and heart rate.

9. The system for an electronic boxing bag set forth in claim 1, wherein said fitness sensor is embedded on a band, said band is configured to be worn by a user, said fitness sensor is configured to measure heart rate and calories, said fitness sensor collaborates with the at least one integrated sensor of the heavy bag, said at least one integrated sensor is configured to determine the hit speed, the hit count, and the hit force.

10. The system for an electronic boxing bag set forth in claim 1, wherein the first camera is a built-in camera.

11. The system for an electronic boxing bag set forth in claim 1, wherein the first camera is an attachable/detachable camera that can be removably mounted to the heavy bag.

12. A system for an electronic boxing bag, comprising:

a) a heavy bag assembly including a heavy bag with at least one integrated sensor embedded therein measuring data, said heavy bag assembly further includes a screen, a speaker and a camera mounted on the heavy bag, said speaker is a 360° speaker, said screen is a 360° screen, said screen, said camera and said speaker are embedded in a top portion of the heavy bag, said heavy bag assembly further includes mounting straps with clips to mount said heavy bag to a mounting element, wherein said mounting straps are mounted to a stand assembly, said stand assembly includes a first bar, a second bar, a base support and a mounting member, said first bar is vertically attached to said base support, said second bar is attached to the first bar, said mounting member is attached to said second bar, said mounting straps are configured to hang the heavy bag from the mounting member of the stand assembly, wherein the heavy bag assembly further includes a second camera mounted on top ends of the mounting straps, wherein the screen has a game mode that indicates the areas and types of hits to be done, wherein the integrated sensor is configured to measure a hit force, a hit speed, and a hits counting;

b) a fitness sensor assembly including a fitness sensor mounted on a user accessory, said fitness sensor is configured to measure training data from the user including heart rate and calories; and c) a computerized device wirelessly connected to the heavy bag assembly and to the fitness sensor assembly to record the measured data and the training data, wherein the computerized device is a smartphone programmed with an app, said app displaying the measured data of the user.

13. A system for an electronic boxing bag, comprising:

a) a heavy bag assembly including a heavy bag with at least one integrated sensor embedded therein measuring data, said heavy bag assembly further includes a screen, a speaker and a camera mounted on the heavy bag, said speaker is a 360° speaker, said screen is a 360° screen, said screen, said camera and said speaker are embedded in a top portion of the heavy bag, said heavy bag assembly further includes mounting straps with clips to mount said heavy bag to a mounting element, wherein said mounting straps are mounted to a stand assembly, said stand assembly includes a first bar, a second bar, a base support and a mounting member, said first bar is vertically attached to said base support, said second bar is attached to the first bar, said mounting member is attached to said second bar, said mounting straps are configured to hang the heavy bag from the mounting member of the stand assembly, wherein the heavy bag assembly further includes a second camera mounted on top ends of the mounting straps, wherein the screen has a training mode that indicates the areas and types of hits to be done, wherein the integrated sensor is configured to measure a hit force, a hit speed, and a hits counting;

b) a fitness sensor assembly including a first fitness sensor integrated on a boxing gloves and a second fitness sensor integrated on a band, wherein the first fitness sensor is adapted to measure heart rate, calories, hit force, hit speed, and hit counting, wherein the second fitness sensor is adapted to measure heart rate and calories, wherein the band and the heavy bag are capable of being used to measure the heart rate, the calories, the hit force, the hit speed, and hit counting, and the gloves are adapted to be worn to measure the heart rate, the calories, the hit force, the hit speed, and hit counting; and c) a computerized device wirelessly connected to the heavy bag assembly and to the fitness sensor assembly to record the measured data and the training data, wherein the computerized device is a smartphone programmed with an app, said app displaying the measured data of the user.

* * * * *